US005811716A

United States Patent [19]

Ellzey

[11] Patent Number: 5,811,716

[45] Date of Patent: Sep. 22, 1998

[54] DEVICE FOR CATCHING CARTRIDGES EJECTED FROM FIRED WEAPONS

[76] Inventor: Andre M. Ellzey, 8823 Slumber La., Converse, Tex. 78109

[21] Appl. No.: 780,740

[22] Filed: Jan. 8, 1997

[51] Int. Cl.[6] ..... F41A 9/00; F41A 15/00

[52] U.S. Cl. ..... 89/33.4; 42/98; 232/44

[58] Field of Search ..... 89/33.4; 42/98; 206/3; 232/1 R, 43.1, 44

[56] References Cited

U.S. PATENT DOCUMENTS

| | | | |
|---|---|---|---|
| 663,262 | 12/1900 | Dieterich | 42/98 X |
| 1,304,468 | 5/1919 | Fernandez | 42/98 X |
| 3,153,981 | 10/1964 | Brass | 89/33.4 |
| 3,658,241 | 4/1972 | Pistocchi | 232/1 R |
| 4,028,834 | 6/1977 | Dobson | 42/98 |
| 4,110,927 | 9/1978 | Morris | 42/98 |
| 4,296,565 | 10/1981 | Jaffin et al. | 42/98 |
| 4,334,375 | 6/1982 | Olson | 42/98 |
| 4,715,141 | 12/1987 | Kohnke | 42/98 |
| 4,959,918 | 10/1990 | Perez | 42/98 |
| 5,138,787 | 8/1992 | Riddle et al. | 42/98 |

OTHER PUBLICATIONS

"Brass–Away Brass Catcher" advertisement; *Guns & Ammo*, Dec. 1994, p. 17 (R.G.F. Ltd., Canoga Park, CA).

*Primary Examiner*—Michael J. Carone
*Assistant Examiner*—Matthew J. Lattig
*Attorney, Agent, or Firm*—Gunn, Lee & Miller, P.C.

[57] ABSTRACT

A device for catching cartridges ejected from a fired weapon. The device includes a fabric catch bag mounted on a frame and attached by means of a swivel mount to an extendable, base-mounted support rod. The frame may rotate about an axis parallel to the support rod or may pivot vertically. Cartridges ejected from a gun being fired adjacent to the bag will enter the bag and be contained therein, rather than falling onto the ground.

10 Claims, 4 Drawing Sheets

34
38
16
38b
36
36a
41
43
40
42
38c 48b
50b
48a
48
46
52
18
50
50a
30a
32
30
30b
32c
28

32b
26
32a
12b
23a
23
22
24
12d
12
12c 12a
20

DEVICE FOR CATCHING CARTRIDGES EJECTED FROM FIRED WEAPONS

FIELD OF THE INVENTION

A device for catching cartridges ejected from a fired weapon, more specifically, a fabric catch bag swivel mounted on an extendable-base, mounted rod.

BACKGROUND OF THE INVENTION

Hunters and other rifle and hand gun users often use a firing range to sharpen their marksmanship. At the firing range, they stand, kneel, lie prone, or sit and fire their weapons at a target. Many of their weapons, upon firing, eject the spent cartridge, typically to one side of the weapon.

Devices are available to catch these spent cartridges for collection by the sportsman. Such devices typically comprise a catch means, such as a fabric bag, mounted to a frame which, in turn, is mounted on a rod to a support base.

Typical of such devices is the Brass-Away Brass Catcher available from R.G.F. Ltd. of Canoga Park, Calif. The Brass-Away Brass Catcher has a fabric bag attached to a rectangular frame and is mounted to a tripod base. It is designed to solve the problem of having to pick up spent brass cartridges after firing. This is done by providing a rectangular frame with a mesh bag mounted on it and mounted on a rod to a tripod base.

While useful to an extent, the Brass-Away Brass Catcher and other similar devices lack flexibility in the method of mounting the thin fabric bags to the support bases to accommodate the various firing positions and levels at which the fired weapon is located. Moreover, such prior art devices also have other design shortcomings more particularly in the manner in which the fabric bags hang. When the fabric bags hang with their mouth vertical, the bag body may obscure or obstruct the mouth opening. When such a condition exists, that is, without the body of the bag positively maintained away from the vertical mouth opening, cartridges may go through the mouth of the bag but bounce or slide back out of the mouth when they engage the body of the bag as it hangs across the mouth opening.

Applicant has addressed, in a unique ejected cartridge catcher, these and other shortcomings of the existing devices. More particularly, Applicant has provided for, in an ejected cartridge catcher, a device in which the fabric bag is positively maintained away from the mouth of the bag while allowing the bag to be located in a variety of positions so as to accommodate the wide variety of shooting positions of the user.

OBJECTS OF THE INVENTION

It is an object of Applicant's unique device to provide for, in a mount to hold a hoop assembly on which a mesh bag is mounted, means for rotating the hoop assembly about an axis perpendicular to an extendable support rod.

It is another object of Applicant's unique device to provide for an engagement means for accepting the hoop assembly, the engagement means capable of engaging the hoop assembly when the extendable support rod is not mounted thereto.

It is yet another object of Applicant's device to provide for a funnel-shaped catch bag attached to a hoop assembly, the hoop assembly comprising at least two similarly-shaped frame members rigidly attached to a support means, one of the two frame members capable of being pivoted in a manner to hold the body of the bag away from the other member to which the mouth of the bag is mounted.

It is a further object of Applicant's device to provide for a telescoping tube on which to swivel mount the hoop assembly.

These and other objects will be apparent with reference to Applicant's specifications and drawings.

SUMMARY OF THE INVENTION

These and other objects are attained in a device for catching cartridges ejected from a fired weapon, the device comprising a catch bag which has a mouth and a body, a hoop assembly which includes means for mounting the catch bag in an mouth-open position with the body of the bag removed from the mouth, a base, an extendable support rod for supporting the hoop assembly with the mounted catch bag at a preselected elevation above the base, a swivel mount for engaging the extendable support rod to the hoop assembly such so that the hoop assembly may be rotated about an axis aligned with the longitudinal axis of the extendable support rod, and engagement means for mounting the extendable support rod to the base.

BRIEF DESCRIPTION OF THE DRAWINGS

FIG. 2*a* is a top elevational view of the base of Applicant's present invention.

FIG. 2*b* is an exploded side elevational view of the extendable rod of Applicant's present invention.

FIG. 2*c* is a top elevational view of the swivel clamp of Applicant' present invention.

FIG. 2*d* is a side elevational view of the hoop assembly of Applicant's present invention.

DETAILED DESCRIPTION OF THE PREFERRED EMBODIMENT

Figure 1:
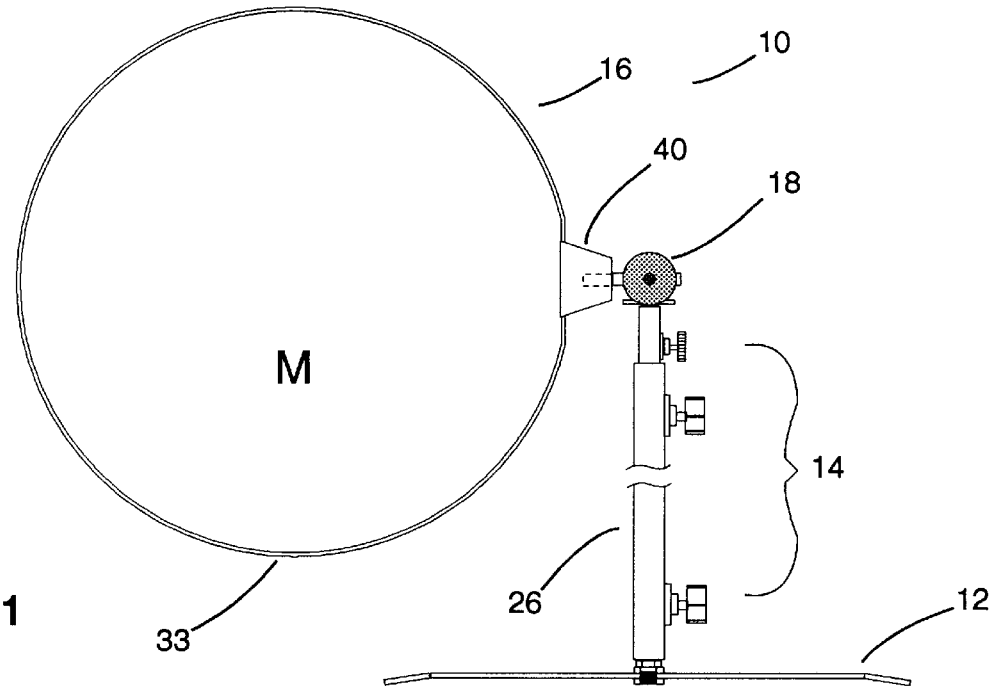
FIG. 1 is a front elevational view of the cartridge catcher of Applicant's present invention with the hoop assembly pivoted so that it is perpendicular to the axis of the support rod.

FIG. 1 illustrates Applicant's cartridge catcher (10) which is seen to comprise a base (12) for mounting cartridge catcher (10) on the ground or another support surface. Base (12) has a vertically-mounted, extendable (telescoping) rod assembly (14) attached from a central portion thereof to support a hoop assembly (16) thereon. In the embodiment illustrated in FIG. 1, it is seen that hoop assembly (16) is connected to extendable rod assembly (14) through a swivel clamp (18). The swivel clamp, as is further set forth below, can mount hoop assembly (16) in the position illustrated in FIG. 1—that is, with the axis of the hoop assembly perpendicular to the axis of the extendable rod assembly (14).

However, swivel clamp (18) is also capable of holding hoop assembly (16) at any angle between that illustrated in FIG. 1 and an angle rotated 90° (clockwise, as illustrated in Example 1) so that the hoop assembly is aligned coincident with the extendable rod assembly (14).

FIG. 1 also illustrates how the hoop assembly (16) consists of a frame assembly (33) to which is attached a frame holding assembly (40) which, in turn, mounts to swivel clamp (18).

Figures 2A, 2B, 2C, 2D:
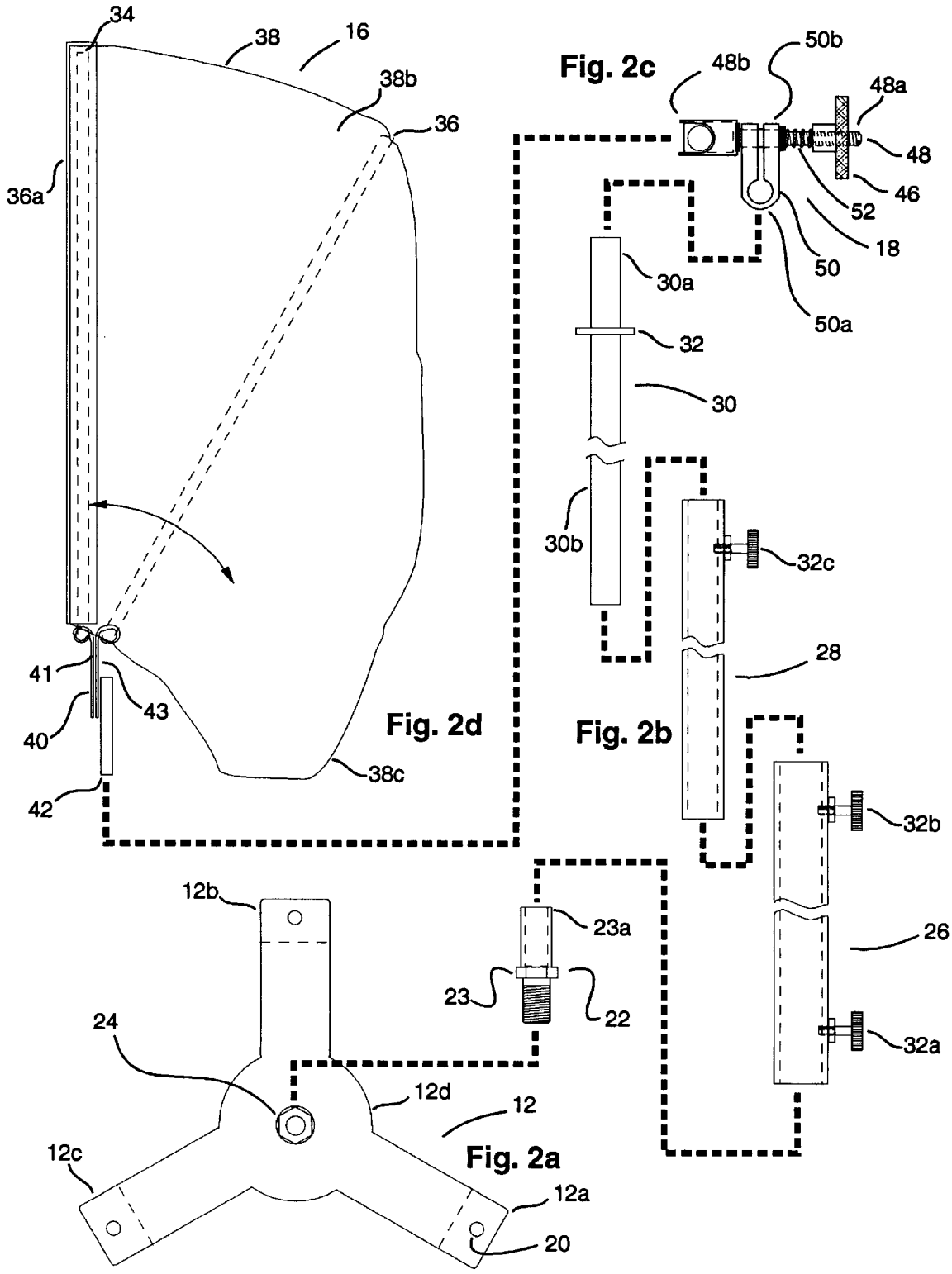
FIGS. 2*a*–2*d* is a series of figures which are exploded away from the device so as to show the various parts, as set forth below.

FIG. 2*a* provides details of base (12) of Applicant's present invention. Other details of the base may be seen in FIGS. 1 and 4. It is seen that base (12) is comprised of three arms (12*a*), (12*b*) and (12*c*), all extending from a central portion (12*d*). Moreover, base (12) is seen to have holes (20) at the removed end of the arms. These holes are provided to allow stakes (not shown) to be driven through the arms to affix the base (and thus the device) to a support surface or the earth. The stakes will help prevent Applicant's cartridge catcher (10) from falling over. Moreover, it can be seen with reference to FIGS. 1 and 4 that the removed ends of arms (12*a*), (12*b*) and (12*c*) may be bent (dotted lines in FIG. 2*a*) to maintain center portion (12*d*) in an elevated position.

With reference to FIG. 2*a*, it is seen that center portion (12*d*) has a threaded hole (24) therein for receipt of a tube/bolt assembly (22) therein. The tube/bolt assembly (22) is comprised of a bolt (23) with threads extending downward in a first direction and, welded to the head of the bolt, a tube (23*a*). The entire tube/bolt assembly (22) is threaded into threaded hole (24) and is designed to accept the extendable rod (14) thereon as is set forth in more detail below.

FIG. 2*b* illustrates, in conjunction with FIG. 1, the details of extendable (telescoping) rod assembly (14). The function of rod assembly (14) is to support hoop assembly (16) at swivel clamp (18) vertically above center portion (12*d*) of base (12). Moreover, it is seen that rod assembly (14) consists of a base tube (26) insertable onto tube/bolt assembly (22) into which slides intermediate tube (28). Both base tube (26) and intermediate tube (28) have thumbscrews (32*a*), (32*b*) and (32*c*) thereon. The thumbscrews are threaded through the walls of the tube with thumbscrews (32*a*) and (32*b*) in base tube (26) used, when tightened down, to hold intermediate tube (28) at a preselected desired vertical position above base (12) so as to locate hoop assembly (16) at the proper position adjacent the weapon. Insertable into intermediate tube (28) is rod (30), which rod has an upper portion (30*a*) and a lower portion (30*b*) separated by a stop plate (32). Lower portion (30*b*) of rod (30) is inserted into intermediate tube (28) and locked into position through the use of thumbscrew (32*c*). As is seen in FIG. 2*b*, rod (30) is insertable into intermediate tube (28) up to stop plate (32). In other words, upper portion (32*a*) is prevented from entering intermediate tube (28) by stop plate (32).

Figures 3C, 5:
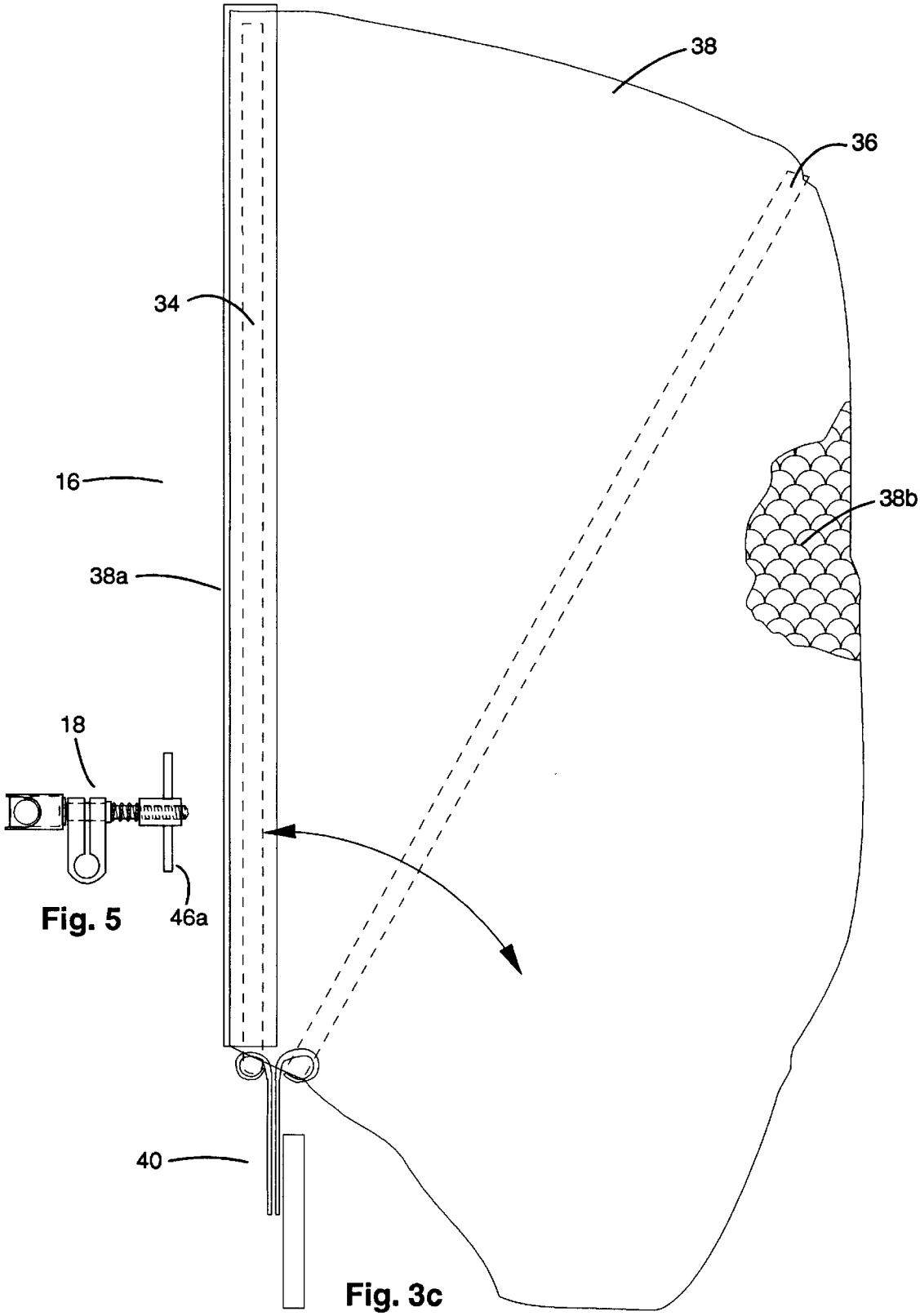
FIG. 3*c* is a side elevational view of the hoop assembly of Applicant's present invention.
FIG. 5 is a top elevational view of an alternate preferred embodiment of a swivel clasp having a T-shaped handle.

It is seen in FIG. 2*c* how the swivel clamp is designed to accept upper portion (30*a*) of the support rod as well as hoop assembly (16). More specifically, it is seen that swivel clamp (18) is comprised of a shaft (48) which has a threaded end (48*a*) to which a knob (46) threadably engages. At the removed end of shaft (48) is hoop assembly mounting rod receiving member (48*b*) which is designed to maintain hoop assembly (16) as set forth in more detail with reference to FIG. 2*d* below. Turning back now to the details of swivel clamp (18), it is seen that intermediate between rod receiving member (48*b*) and threaded end (48*a*) of shaft (48) is located thereon slotted member (50) which includes a rod receiving end (50*a*) as well as a shaft receiving end (50*b*). Between slotted member (50) and knob (46) and mounted so as to encircle shaft (48) is coil spring (52). It is seen from FIG. 2*c* how the rotation of knob (46) will compress spring (42) which will then compress shaft receiving end (50*b*) of slotted member (50) so as to pinch any rod inserted in rod receiving end (50*b*) of slotted member (50). Thus, the structure of swivel clamp (18) as set forth above allows it to receive hoop assembly (16) and rod (30) in such a way that shaft (48) and thus the axis of hoop assembly (16) may be rotated with respect to the axis of extendable rod assembly (14). More particularly, it is seen that, if swivel clamp (18) were placed, with the orientation of rod receiving member (48*b*) and rod receiving end (50*a*) as illustrated in FIG. 3*c* onto upper portion (30*a*) of the assembled rod assembly (14), hoop assembly (16) would be oriented such that the axis of hoop assembly (indicated by hoop assembly mounting rod (42)) would be parallel with the axis of extendable rod assembly (14). Moreover, it can be seen that tightening down on knob (46) would act to compress spring (52) and shaft receiving end (50*b*) to rod receiving member (48*b*) so as to maintain that alignment. Loosening knob (46) however would allow rotation of shaft (48) so as to position rod receiving member (48*b*) such that hoop assembly (16) is at an angle not parallel with that of extendable rod assembly (14). Thus, it is seen that the nature of Applicant's swivel clamp is such that it allows for the pivoting of the axis of the hoop assembly with respect to extendable support rod. Moreover, it can be seen that the entire swivel clamp assembly can be rotated about the axis of extendable rod assembly (14) by pivoting swivel clamp (18) about upper portion (30*a*) and thus rotating the face or mouth of the hoop assembly (M), as seen in FIG. 1, with respect to the longitudinal axis of extendable support rod (14).

FIG. 2*d* illustrates the details of the structure of Applicant's hoop assembly (16). It can be seen that hoop assembly (16) is comprised of a frame assembly (33) which has two frames, a fixed frame (34) and a pivoting frame (36). Fixed frame (34) defines a mouth or face (M) (see FIG. 1). The two frames comprising frame assembly (33) are typically identical in shape and either round or rectangular. To fixed frame (34) is mounted a mesh bag (38) having a mouth portion (38*a*), which is attached to the fixed frame (34), and a body portion (38*b*) which engages pivoting frame (36). Moreover, it is seen that mesh bag (38*a*) is typically conically shaped, somewhat like a windsock, and has an open, removed end (38*c*) which hangs below frame assembly (33).

Frame assembly (33) is mounted to swivel clamp (18) through the use of a frame-holding assembly (40) as set forth in FIGS. 2*d*, 3*a*, 3*b*, and 3*c*. Frame-holding assembly (40) is comprised of a plate (41) for rigidly mounting fixed frame (34) thereto to which is joined a plate (43) for pivotally mounting pivoting frame (36) thereto. Both plates (41) and (43) are joined together and have mounted thereto a hoop assembly mounting rod (42) which in turn is designed to engage swivel clamp (18) at rod receiving end member (48*b*) as set forth above.

Figure 3B:
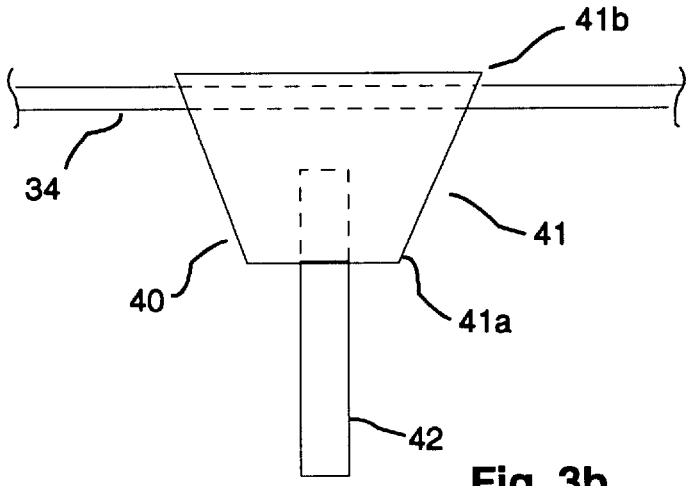
FIG. 3*b* is a front elevational view of the frame holding assembly of Applicant's present invention.
Figure 3A:
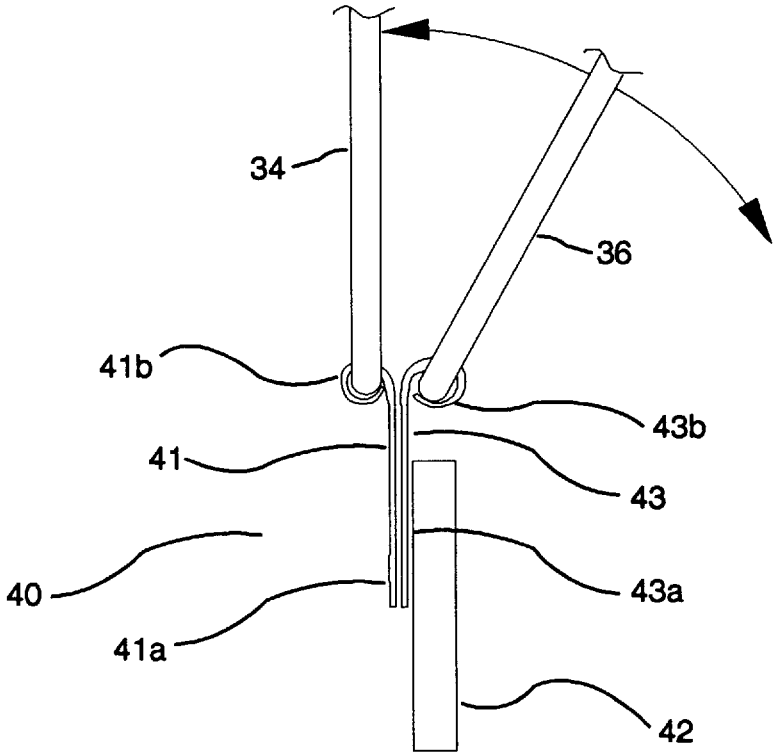
FIG. 3*a* is a side elevational view of the frame holding assembly of the hoop assembly of Applicant's present invention.

With reference to FIG. 3*a*, it is seen how plate (41) has a flat end (41*a*) and a curved end (41*b*), the curved end for wrapping around a portion of fixed frame (34). A weld between curved end (41*b*) and that portion of fixed frame (34) which engages it will prevent rotation of fixed frame (34) and maintain fixed frame (34) rigid with respect to frame holding assembly (40).

FIGS. 3*b*, 3*a* on the other hand, illustrates that pivoting frame (36) engages plate (43) at curved end (43*b*) in a loose arrangement. The loose arrangement between curved end (43*b*) of plate (43) and pivoting frame (36) allows the pivoting action of pivoting frame (36) with respect to frame holding assembly (40). Removed end **(43*a*) flushly engages plate (41) and both plates together mount to hoop assembly mounting rod (42)** by a weld or otherwise.

FIG. **3*c* provides additional details, more specifically, FIG. 3*c* illustrates the manner in which pivoting frame (36) may be moved so that it is flush against fixed frame (34), which then allows body (38*b*) of mesh bag (38) to hang flush across mouth (M), this position typically being utilized for storage of the disassembled unit, and, also the manner in which the pivoting frame (36) may be rotated away from fixed frame (34) so as to maintain body (38*b*) of mesh bag (38) away from mouth or face (M) of hoop assembly (16) so as to allow spent cartridges, ejected from the firearm, to enter through mouth (M) without interference from the body of the bag until the cartridges are well within the body. In other words, pivoting frame (36) will prevent the body of mesh bag (38) from closing off mouth (M) of hoop assembly (16)**.

Figure 4:
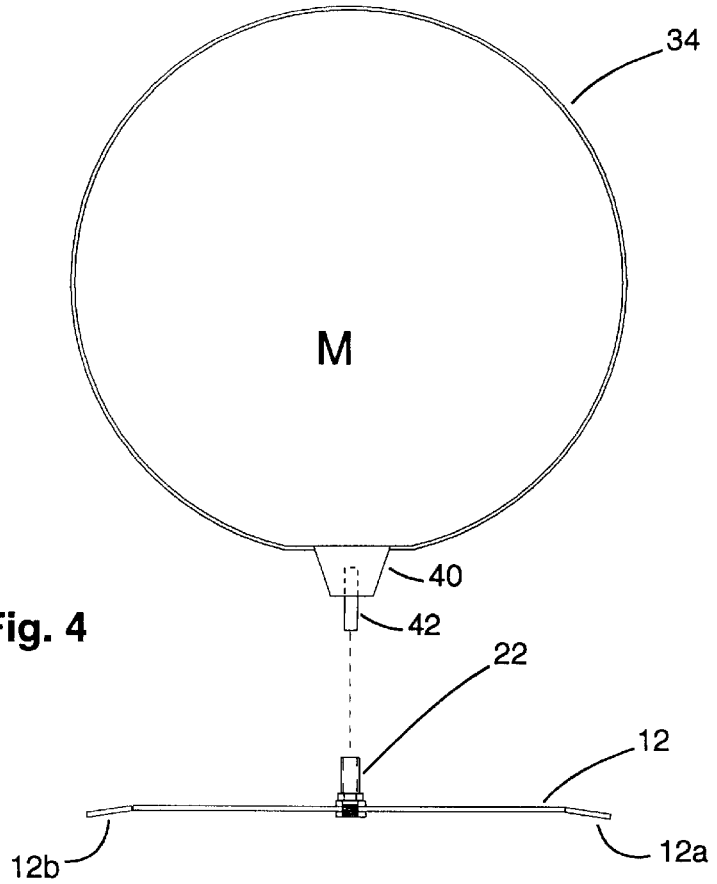
FIG. 4 is a front elevational view of Applicant's present invention in an embodiment in which the hoop assembly connects directly to the base.

FIG. 4 illustrates an alternate preferred embodiment of Applicant's invention which allows hoop assembly (16) to directly engage tube/bolt assembly (22) in a manner that omits from cartridge catcher (10), extendable rod (14). By providing in Applicant's invention a means in which to directly mount to frame holding assembly (40), the prone position can be utilized for firing.

FIG. 5 illustrates the use of a swivel mount (18) with a T-shaped handle **(46*a*)** instead of a knurled knob, the T-shaped handle being easier to form.

Additional details of the parts of Applicant's invention are set forth below.

The mesh bag would typically have ¼" openings and be utilized with 1/16" strands so as to be within the NRA high-power rifle/pistol rules of not being a windbreaker. The removed end of the mesh bag may be opened or closed and, when closed, will retain the spent shells until the shooter empties it. The hoop assembly may, in a preferred embodiment, consist of two 16" diameter, 3-gauge wire hoops, one being the fixed frame, the other the pivoting frame. The fixed frame is welded to maintain the hoop in a vertical position relative to the fixture and the second hoop is allowed to rotate from vertical to well beyond 90°, the maximum in use rotation typically not more than 45°.

The bag is attached to the hoop assembly by slipping mouth portion **(38*a*)** over the fixed frame and is typically secured to the fixed tube with VELCRO®-type tape. One type of fabric for the mesh bag is Style PB18, 100% polyester, manufactured by Apex Aridyne Corp. in Inwood, N.Y.

A source of Applicant's swivel clamp (18) is a gauge and indicator swivel clamp, standard duty, with ¼" by ¼" knurled knob and manufactured by GEM Instrument Co. of Brunswick, Ohio. Rod (30) may be made in ¼" diameter, typically 24" long with a large area washer welded ¾" down from the top to define stop plate (32). Intermediate tube (28) is typically comprised of a ⅜" (0.061 inch wall) round tube, 24" long, with one 10–24 welded nut, welded 1" from the top and one 10–24 thumbscrew installed through weld nut and tube wall. Rod (30) slides freely inside intermediate tube (28) until held in place with the pressure from thumbscrew as set forth above.

Base tube may be made from 9/16" (0.058 inch wall) round tube, 24" long, with two ¼" weld nuts welded 1" from each end with ¼—20 thumbscrews installed through weld nuts and tubes. Intermediate tube slides freely into base tube until secured by the thumbscrews as set forth above.

Base (12) may be manufactured from 11 gauge steel with a 1-½"—20, plain steel hex-high nut welded at center to provide threaded hole (24). Arms **(12*a*), (12*b*) and (12*c*) provide support to the entire cartridge catcher assembly (10)**, each prong typically having a 150 downward bend 1-½" from the removed ends for stability.

Tube bolt assembly (22) may be manufactured utilizing one ⅜" (0.058 inch wall) round tube, 2" long welded to the top of a hex head, ½"—20 bulk with a ½" shank. This unit screws into the base plate and is tightened down at threaded hole (24).

All metal is typically zinc plated with a bright finish (excluding thumbscrews). As described above, the telescopic base assembly adjusts from the low of 2' (prone) to a height of 6'6" (standing) measured from base to the center of mouth (M) of hoop assembly (16).

By removing the telescopic parts in the swivel and setting the hoop assembly directly to the base as set forth in FIG. 4, a height of even lower than 2' may be attained, but loses the ability to pivot the hoop assembly.

In use, sandbags or any other type of weight can be placed on the base to keep the unit stable if conditions become windy. Large spikes or nails could be placed through the holes in the base and driven into the ground. When the base is placed on the support surface, the extendable tube is secured so that thumbscrew **(32*a*) is tightened against tube (23*a*). The height of hoop assembly (16) is then adjusted, and thumbscrews (32*b*) and (32*c*) are tightened. Then, with knob (46) loosened, hoop assembly (16) is positioned so that the axis of hoop assembly rod (42) is either parallel to the axis of extendable rod assembly (14) or at some angle thereto. For example, in FIG. 1 the cartridge catcher is adjusted with the hoop assembly perpendicular to support rod, that is with the hoop assembly mounting rod (42) perpendicular to extendable rod assembly (16). However, if the shooting position requires it, the hoop assembly could be mounted such that it was parallel with extendable rod (14) by rotating it 90° in the position illustrated in FIG. 1. Moreover, the hoop assembly, when in any position, can be rotated about the axis represented by mounting rod (42) to provide for the variation to the shooter. After the appropriate position is determined, all thumbscrews and knob (46)** are checked for tightness; and shooting commences with mouth (M) adjacent the weapon so as to catch the spent cartridges.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A device for catching cartridges ejected from a fired weapon, the device comprising:

a catch bag having a mouth and a body;

a hoop assembly including means for mounting said catch bag with the mouth of said catch bag in an open position and the body removed therefrom;

a base for maintaining the device on a support surface;

an extendable support rod for supporting said hoop assembly with said catch bag thereon at preselected elevations above said base;

a swivel mount for engaging said extendable support rod to said hoop assembly such that said hoop assembly may be rotated about an axis aligned with the longitudinal axis of said extendable support rod wherein said swivel mount includes means for rotating said hoop assembly to an axis perpendicular to said extendable support rod; and engagement means for mounting said extendable support rod to said base.

2. The device of claim 1, wherein said engagement means also includes means for accepting said hoop assembly directly thereon when said extendable support rod is not mounted thereto.

3. The device of claim 1, wherein the body of said catch bag is comprised of a funnel-shaped mesh fabric.

4. The device of claim 1, wherein said means for mounting said catch bag includes a fixed frame for engaging the mouth of said catch bag and a pivoting frame articulated with respect to the fixed frame for engaging the body of said catch bag.

5. The device of claim 1, wherein said extendable support rod includes a tube with a rod insertable therein and means for adjustably fixing the rod at selected positions within said tube.

6. The device of claim 5, wherein said means for mounting said catch bag includes a fixed frame for mounting the mouth of the catch bag thereto, and a pivoting frame articulated with respect to the fixed frame for maintaining the body of the catch bag away from the mouth of the catch bag.

7. The device of claim 6, wherein said swivel mount is capable of adjustably locating said hoop assembly between a position adjacent said extendable support rod to a position above said extendable support rod.

8. A device for catching cartridges ejected from a fired weapon, the device comprising:

a funnel-shaped, mesh catch bag having a mouth and a body;

a frame assembly including a fixed frame for mounting the mouth of the mesh catch bag thereto and a pivoting frame articulated with respect to the fixed frame for pivoting from a position adjacent the fixed frame to a position away from the fixed frame, the away position for maintaining the body of the bag away from the fixed frame;

a support rod having a near end and a removed end;

a base for placing on a support surface, the base being removably attached to a near end said support rod; and a swivel clamp having a first member for pivotally engaging the removed end of the support rod and a second member for engaging said frame assembly, the second member capable of being rotated with respect to the first member.

9. The device of claim 8, wherein said mesh catch bag has ¼" openings.

10. The device of claim 9, wherein said base is capable of rotatably engaging the frame assembly when the support rod is removed therefrom.

* * * * *